US009414626B2

(12) United States Patent
Möhring et al.

(10) Patent No.: US 9,414,626 B2
(45) Date of Patent: Aug. 16, 2016

(54) CIGARETTE PAPER WITH FILLER MATERIAL WITH SPECIAL PARTICLE SIZE DISTRIBUTION

(71) Applicant: delfortgroup AG, Traun (AT)

(72) Inventors: Dieter Möhring, Wattens (AT); Roland Zitturi, Innsbruck (AT); Kannika Pesendorfer, Salzburg (AT); Dietmar Volgger, Schwaz (AT)

(73) Assignee: delfortgroup AG, Traun (AT)

( * ) Notice: Subject to any disclaimer, the term of this patent is extended or adjusted under 35 U.S.C. 154(b) by 0 days.

(21) Appl. No.: 14/433,789

(22) PCT Filed: Oct. 8, 2013

(86) PCT No.: PCT/EP2013/070945
§ 371 (c)(1),
(2) Date: Jul. 2, 2015

(87) PCT Pub. No.: WO2014/056912
PCT Pub. Date: Apr. 17, 2014

(65) Prior Publication Data

US 2015/0327593 A1 Nov. 19, 2015

(30) Foreign Application Priority Data

Oct. 10, 2012 (DE) ..... 10 2012 109 642

(51) Int. Cl.

| | |
|---|---|
| ***A24D 1/02*** | (2006.01) |
| ***D21H 17/67*** | (2006.01) |
| ***D21H 17/68*** | (2006.01) |
| ***D21H 21/50*** | (2006.01) |
| ***D21H 21/52*** | (2006.01) |

(52) U.S. Cl.
CPC ..... *A24D 1/02* (2013.01); *D21H 17/67* (2013.01); *D21H 17/675* (2013.01); *D21H 17/68* (2013.01); *D21H 21/50* (2013.01); *D21H 21/52* (2013.01)

(58) Field of Classification Search
None
See application file for complete search history.

(56) References Cited

U.S. PATENT DOCUMENTS

| | | | | |
|---|---|---|---|---|
| 5,861,209 | A * | 1/1999 | Haskins | D21H 19/385 428/330 |
| 2002/0157678 | A1 | 10/2002 | Hampl | |
| 2003/0131860 | A1 * | 7/2003 | Ashcraft | A24D 1/025 131/365 |
| 2006/0054291 | A1 * | 3/2006 | Dimmick | C09C 1/021 162/135 |
| 2007/0084475 | A1 * | 4/2007 | Oglesby | A24D 1/025 131/365 |
| 2009/0044819 | A1 | 2/2009 | Fritzsching | |

OTHER PUBLICATIONS

International Bureau of WIPO, Authorized Officer Nora Linder, English Translation of the International Preliminary Report on Patentability, PCT/EP2013/070945, date of mailing Apr. 23, 2015, 8 pages.

* cited by examiner

*Primary Examiner* — Michael J Felton
(74) *Attorney, Agent, or Firm* — Sunstein Kann Murphy & Timbers LLP

(57) ABSTRACT

A cigarette paper is disclosed which contains pulp fibres and filler material particles, wherein at least 50% by weight, preferably at least 70% by weight and particularly at least 90% by weight of the filler material has a particle size distribution measured in accordance with ISO 13320 for which for the distribution parameter $p=d_{10}+2\cdot d_{30}+2\cdot d_{70}-d_{90}$ holds: $p\leq 5.0$ μm, preferably $p\leq 4.0$ μm and particularly preferably $p\leq 3.5$ μm, and $p\geq -1.0$ μm, preferably $p\geq 0.0$ μm and particularly preferably $p\geq 1.0$ μm.

14 Claims, 2 Drawing Sheets

| | Parameters of particle size distribution | | | | Low chalk content 18% | | High chalk content 28% | |
|---|---|---|---|---|---|---|---|---|
| No. | $d_{10}$ | $d_{30}$ | $d_{70}$ | $d_{90}$ | Z | D* | Z | D* |
| | **[μm]** | **[μm]** | **[μm]** | **[μm]** | **[CU]** | **[cm/s]** | **[CU]** | **[cm/s]** |
| 1 | 1.102 | 2.000 | 5.796 | 10.296 | 43.86 | 1.43 | 56.85 | 1.72 |
| 2 | 1.478 | 2.602 | 5.861 | 9.772 | 73.12 | 1.96 | 85.80 | 2.23 |
| 3 | 1.317 | 2.110 | 4.283 | 6.986 | 64.50 | 2.01 | 86.57 | 2.47 |
| 4 | 1.129 | 2.162 | 5.468 | 9.004 | 64.00 | 1.82 | 87.50 | 2.29 |
| 5 | 0.959 | 1.467 | 2.620 | 3.987 | 63.22 | 2.11 | 77.17 | 2.49 |
| 6 | 1.068 | 1.649 | 2.990 | 4.582 | 57.55 | 2.01 | 78.60 | 2.53 |
| 7 | 1.052 | 1.685 | 3.324 | 5.459 | 42.25 | 1.68 | 55.23 | 2.09 |
| 8 | 0.953 | 1.460 | 2.607 | 3.974 | 49.12 | 1.93 | 64.72 | 2.40 |
| 9 | 0.943 | 1.438 | 2.534 | 3.773 | 45.79 | 2.03 | 54.43 | 2.39 |
| 10 | 0.878 | 1.352 | 2.380 | 3.550 | 52.32 | 2.10 | 58.97 | 2.43 |
| 11 | 0.977 | 1.488 | 2.650 | 4.020 | 48.27 | 1.94 | 61.06 | 2.40 |
| 12 | 0.982 | 1.604 | 3.689 | 7.266 | 31.99 | 1.26 | 43.92 | 1.68 |
| 13 | 0.951 | 1.492 | 2.864 | 4.777 | 39.35 | 1.76 | 46.19 | 2.13 |
| 14 | 0.748 | 1.141 | 1.897 | 2.697 | 31.61 | 1.60 | 37.91 | 1.98 |
| 15 | 0.951 | 1.492 | 2.864 | 4.777 | 33.46 | 1.71 | 40.54 | 2.13 |
| 16 | 0.086 | 0.250 | 0.735 | 1.479 | 34.16 | 1.97 | 34.39 | 2.25 |
| 17 | 0.814 | 1.266 | 2.234 | 3.371 | 28.19 | 1.74 | 30.24 | 2.09 |
| 18 | 0.120 | 0.333 | 1.160 | 3.900 | 25.48 | 1.68 | 26.83 | 2.01 |

Fig. 1

| | Distribution parameter | Chalk content 18% | Chalk content 28% | Difference |
|---|---|---|---|---|
| No. | $p=d_{10}+2\cdot d_{30}+2\cdot d_{70}-d_{90}$ | $D^*_{50}$ | $D^*_{50}$ | $\Delta D^*_{50}$ |
| | **[μm]** | **[cm/s]** | **[cm/s]** | **[cm/s]** |
| 1 | 6.398 | 1.53 | 1.61 | 0.08 |
| 2 | 8.632 | 1.62 | 1.70 | 0.09 |
| 3 | 7.116 | 1.77 | 1.88 | 0.11 |
| 4 | 7.384 | 1.61 | 1.73 | 0.13 |
| 5 | 5.144 | 1.87 | 2.00 | 0.13 |
| 6 | 5.764 | 1.88 | 2.01 | 0.14 |
| 7 | 5.611 | 1.83 | 1.98 | 0.16 |
| 8 | 5.113 | 1.95 | 2.11 | 0.16 |
| 9 | 5.116 | 2.12 | 2.29 | 0.17 |
| 10 | 4.792 | 2.05 | 2.24 | 0.18 |
| 11 | 5.231 | 1.97 | 2.17 | 0.20 |
| 12 | 4.301 | 1.57 | 1.79 | 0.22 |
| 13 | 4.887 | 1.98 | 2.22 | 0.24 |
| 14 | 4.128 | 2.02 | 2.28 | 0.26 |
| 15 | 4.887 | 2.09 | 2.37 | 0.28 |
| 16 | 0.577 | 2.38 | 2.72 | 0.34 |
| 17 | 4.444 | 2.32 | 2.69 | 0.36 |
| 18 | -0.794 | 2.35 | 2.74 | 0.39 |

Fig. 2

CIGARETTE PAPER WITH FILLER MATERIAL WITH SPECIAL PARTICLE SIZE DISTRIBUTION

FIELD OF THE INVENTION

The present invention relates to a cigarette paper which contains pulp fibers and filler material particles. Herein, the term "contains" does not exclude that the cigarette paper contains further components. In particular, it relates to a cigarette paper which allows the amount of carbon monoxide in cigarette smoke, to be reduced, and to a corresponding cigarette.

BACKGROUND AND PRIOR ART

It is generally known that cigarette smoke contains many harmful substances, among them carbon monoxide. Therefore, there is a great interest in the industry to produce cigarettes the smoke from which contains considerably fewer harmful substances. To reduce the amount of such substances, cigarettes are often equipped with filters, typically formed from cellulose acetate. These filters, however, are not suitable for reducing the carbon monoxide content in the smoke from the cigarette, as cellulose acetate cannot absorb carbon monoxide. Various proposals for incorporating catalysts into the filter have so far not been successful, partially for functional and partially for economic reasons.

It is also known to dilute the smoke generated in the cigarette with an air flow flowing through a perforation in the tipping paper. In this regard, the carbon monoxide content of the cigarette smoke can indeed be reduced, however at the price of diluting the substances which determine the taste of the cigarette and thus of having a negative influence on the taste sensation of the cigarette and consumer acceptance.

The substances in cigarette smoke are determined by a method in which the cigarettes are smoked according to standardized protocols. Such a method is, for example, described in ISO 4387. In this regard, the cigarette is at first lit at the start of the first puff, and then each minute a puff is taken at the mouth end of the cigarette with a duration of 2 seconds and a volume of 35 $cm^3$, following a sinusoidal puff profile. The puffs are repeated until the length of the cigarette drops below a length defined in the standard. The smoke flowing from the mouth end of the cigarette during the puffs is collected in a Cambridge Filter Pad and this filter is afterwards chemically analyzed for its content of various substances, for example nicotine. The gas phase flowing out of the mouth end of the cigarette and through the Cambridge Filter Pad during the puffs is collected and also chemically analyzed, for example, to determine the carbon monoxide content in the cigarette smoke.

During standardized smoking, the cigarette is thus in two different states of flow. During the puff, there is a considerable pressure difference, typically in the range from 200 Pa to 1000 Pa, between the inner side facing the tobacco and the outer side of the cigarette paper. This pressure difference causes air to flow through the cigarette paper into the tobacco part of the cigarette and dilutes the smoke generated during the puff. During this phase, which last for 2 seconds per puff, the extent of dilution of the cigarette smoke is determined by the air permeability of the paper. The air permeability is determined in accordance with ISO 2965 and indicates which air volume per unit time, per unit area and per pressure difference flows through the cigarette paper, and thus has the dimension $cm^2/(min\ cm^2\ kPa)$. It is also referred to as the CORESTA Unit (CU, 1 CU=1 $cm^3/(min\ cm^2\ kPa)$). With this value, the rod ventilation of a cigarette is controlled, that is, the air flow which flows through the cigarette paper into the cigarette during a puff on the cigarette. Typically, the air permeability of cigarette paper is in the range from 0 CU to 200 CU, wherein the range from 20 CU to 120 CU is generally preferred In the time period between the puffs, the cigarette smolders without any appreciable pressure difference between the inside of the tobacco part of the cigarette and the surroundings, so that the gas transport is determined by the difference in gas concentration between the tobacco part and the surroundings. In this regard, carbon monoxide can also diffuse out of the tobacco part through the cigarette paper and into the ambient air. In this phase, which lasts for 58 seconds according to the method described in ISO 4387, the diffusion capacity of the cigarette paper is the relevant parameter for the reduction of carbon monoxide.

The diffusion capacity is a transfer coefficient and describes the permeability of the cigarette paper for a gas flow which is driven by a concentration difference. More precisely, it designates the diffusion capacity of the volume of gas through the paper per unit time, per unit area and per concentration difference and thus has the unit $cm^3/(s.cm^2)$=cm/s The diffusion capacity of a cigarette paper for $CO_2$ can, for example, be determined with the $CO_2$ Diffusivity Meter from the company Sodim and is closely related to the diffusion capacity of cigarette paper for CO.

It can be seen from the above considerations that the diffusion capacity of the cigarette has an independent, important significance for the carbon monoxide content in cigarette smoke and that the levels of carbon monoxide in cigarette smoke can be reduced by increasing the diffusion capacity. This is of particular relevance with respect to the self-extinguishing cigarettes known in the prior art, for which comparably high values of carbon monoxide are observed. In such cigarettes, burn-retardant stripes are applied to the cigarette paper, to achieve self-extinguishment in a standardized test (ISO 12863). This or a similar test is, for example, a part of legal requirements in the USA, Canada, Australia and the European Union. The increased values of carbon monoxide are caused by the fact that carbon monoxide can diffuse through the burn-retardant stripes out of the cigarette only to a very small extent. Thus, it would be of great advantage to provide a cigarette paper which could compensate for this undesired side-effect.

In practice, however, it turns out to be extremely difficult to adjust the diffusion capacity independently of the air permeability of the paper in the paper production process. The air permeability itself, however, is in most cases the subject of paper specifications which the cigarette manufacturers have to comply with, so that—under this requirement—the diffusion capacity results practically from the paper production process and can only be varied within a very small range (compare also *B.E.: The influence of the pore size distribution of cigarette paper on its diffusion constant and air permeability, SSPT*17, 2005, *CORESTA meeting, Stratford-upon-Avon, UK*). The air permeability as well as the diffusion capacity are determined by the porous structure of the cigarette paper, and so there exists a relationship between these parameters which is approximately given by $D^* \sim Z^{(1/2)}$, wherein D* is the diffusion capacity and Z the air permeability. This relationship holds above all in good approximation if the air permeability of the paper is primarily adjusted by refining the pulp fibers.

From the prior art, various approaches are known for increasing the diffusion constant of the cigarette paper by adding thermally instable substances (WO 2012013334) or by selecting the mean size of the filler material particles (EP 1450632, EP 1809128). Despite such tests, there is still a lack of a possibility to substantially increase the diffusion capacity for a given air permeability.

SUMMARY OF THE INVENTION

The objective of the present invention is to provide a cigarette paper which allows a selective reduction of the carbon monoxide content in cigarette smoke at a given air permeability.

This objective is achieved by a cigarette paper according to claim 1. Advantageous further embodiments are given in the dependent claims.

According to the invention, the cigarette paper contains pulp fibers and filler material, wherein at least 50% by weight, preferably at least 70% by weight and particularly preferably at least 90% by weight of the filler material has a particle size distribution measured in accordance with ISO 13320 with Mie-correction for calcite, for which for the distribution parameter $p=d_{10}+2\cdot d_{30}+2\cdot d_{70}-d_{90}$ holds: $p\leq 5.0$ μm, preferably $p\leq 4.0$ μm and particularly preferably $p\leq 3.5$ μm, and $p\geq -1.0$ μm, preferably $p\geq 0.0$ μm and particularly preferably $p\geq 1.0$ μm.

The particle size distribution defines the granulometric condition of a particle collective and describes the probability distribution of the particle size in the particle collective. In accordance with ISO 13320, the particle size is determined from the diffraction pattern of a laser beam. To calculate the particle size from the diffraction pattern, various models are employed, for example, according to Fraunhofer or according to Mie. For the particle sizes relevant here, a model according to Mie with material parameters for calcite is used. From the particle size distribution measured in this manner, it is possible to discern, for example, which volumetric fraction of the particles is below a pre-defined size. Such shares can, for example, be given in the form "$d_x$", wherein x stands for a number between 0 and 100 and d is a measure of the particle size. As an example, $d_{10}=0.5$ μm means that 10% by volume of the particles in the collective are smaller than 0.5 μm.

The particle size "d" therefore corresponds to the diameter of a spherical particle. For particles which are not spherical, it corresponds to the diameter of a spherical particle, which measured in accordance with ISO 13320, leads to the same result as the particle without spherical shape.

Thus, particles which are distributed according to the above mentioned particle size distribution can for the most part be plate-like or non-plate-like and preferably consist of chalk. In this regard, a particle is considered to be non-plate-like when the length l and the width b are less than four times, preferably less than twice as great as the thickness d, wherein the length l, the width b and the thickness d each correspond to the maximum dimensions in three mutually orthogonal spatial directions. For the idealized concept of an almost cuboid geometry, the length l, the width b and the thickness d could, for example, correspond to the sides of the cuboid, i.e. it is not at all necessary for the length l to correspond to the largest dimension of the particle, which for an idealized cuboid would correspond to the body diagonal. As a rule, however, the length l will be greater or equal to the width b and in its turn will differ by a factor of 2.5 or less from the largest spatial dimension of the particle.

The inventors have found that by using filler materials with a special particle size distribution, the diffusion capacity of the cigarette paper can be influenced in a particularly favorable manner. In particular, at a given air permeability, a comparably high diffusion capacity can be achieved.

The shape of the particle size distribution is thereby characterized by four values $d_{10}$, $d_{30}$, $d_{70}$ and $d_{90}$, and from these a distribution parameter p is calculated by using $p=d_{10}+2\cdot d_{30}+2\cdot d_{70}-d_{90}$. The inventors have found that, if this distribution parameter p falls below a magnitude of about 5 μm, an unexpected and large increase in the diffusion capacity of the cigarette paper is obtained. Further, the inventors have found that if the distribution parameter falls below a value of 4.0 μm, a plateau occurs and no similarly large increase in the diffusion capacity can be expected but instead, the diffusion capacity remains at a high level. This relationship is shown in FIG. 3.

The distribution parameter p can also have values less than 0 μm, and in general the particle size distribution is selected so that p is greater than −1 μm.

Preferably, the particle size distribution of the entire filler material in the paper is selected such that the distribution parameter p acquires a value as defined above. However, it is possible in the context of this invention to combine a filler material with the particle size distribution according to the invention with other filler materials with other particle size distributions, as long as the fraction of the filler material with the particle size distribution according to the invention is sufficiently high to provide the described technical effect. For this reason, the fraction of the filler material with the particle size distribution according to the invention of the entire filler content should, as mentioned above, be at least 50% by weight, preferably at least 70% by weight and particularly preferably at least 90% by weight.

The filler material is preferably precipitated chalk. Since the effect caused by the filler materials in the paper is primarily of a physical nature, similar advantages can, however, be achieved with other filler materials, for example magnesium oxide, magnesium hydroxide, aluminum hydroxide, titanium dioxide, iron oxide or combinations thereof.

As mentioned initially, the diffusion capacity D* for conventional paper is to good approximation proportional to the square-root of the air permeability in CU, i.e. $D^*\sim Z^{(1/2)}$. A typical value for the diffusion capacity of $CO_2$ at an air permeability of Z=50 CU is 1.65 cm/s, for example. Until now, it has been technically extraordinarily difficult to vary the diffusion capacity D* independently of the air permeability Z so that at a given air permeability Z, an increased diffusion capacity D* results. By using the filler material of the invention with a particle size distribution of the invention, however, it is possible to increase the diffusion capacity D* for $CO_2$ to $D^*\geq 1.80$ cm/s or more for an otherwise identical paper with an air permeability of Z=50 CU. A similar relative increase in the diffusion capacity D* due to a filler with such a particle size distribution also results for air permeabilities which deviate from Z=50 CU. To quantify this effect for general air permeabilities of x CU as well, the diffusion capacity D* for $CO_2$ can be normalized to an expected diffusion capacity at 50 CU by using the relationship $D^*\sim Z^{(1/2)}$, by multiplying it by a factor $\sqrt{50}/\sqrt{x}$, i.e. $D^*_{50}=D^*_x\cdot\sqrt{50}/\sqrt{x}$.

In an advantageous embodiment of the invention $D^*_x\cdot\sqrt{50}/\sqrt{x}\geq 1.80$ cm/s, preferably ≥1.90 cm/s, and in particular ≥2.0 cm/s holds for the diffusion capacity $D^*_x$ for $CO_2$ of a cigarette paper with an air permeability of x CU. This is particularly the case for air permeability values x in the range $20\leq x\leq 120$, preferably $30\leq x\leq 100$, and at least for papers with filler contents between 20 and 40% by weight.

It was found that for the effect according to the invention the entire particle size distribution is substantially more crucial than the mean particle size alone, i.e. the desired effect can be achieved essentially independently of the mean particle size. In a preferred embodiment, the median value $d_{50}$ of the particle size distribution measured in accordance with ISO 13320 with Mie-correction for calcite is between 0.2 μm and 4.0 μm, preferably between 0.5 μm and 3.0 μm.

The filler material according to the invention can be added to the paper in the usual manner, as is known to the person skilled in the paper production art. In addition, when manufacturing the paper, there is no need for additional special measures after adding the filler material according to the invention.

Preferably, the total filler material content of the paper is between 10% by weight and 45% by weight, particularly preferably between 20% by weight and 40% by weight. Further, the cigarette paper preferably has a basis weight of 10 $g/m^2$ to 60 $g/m^2$, particularly preferably of 20 $g/m^2$ to 35 $g/m^2$.

In a particularly preferred embodiment, the paper is treated with burn-retardant materials in certain areas, which materials are suitable for providing a cigarette manufactured from the paper with self-extinguishing properties. As mentioned initially, such burn-retardant areas inhibit the diffusion of CO out of the cigarette between two subsequent puffs. This is the reason why typically increased CO values are observed for such self-extinguishing cigarettes. This is a considerable problem, as the increased fire protection should not increase the harmfulness to health of the cigarette smoke. With the cigarette paper according to the invention, the typical increase of the CO content in the cigarette smoke due to the burn-retardant areas can be at least partially compensated by the increased diffusion capacity of the paper in the untreated areas. Thus, the invention provides a special technical effect in connection with such treated paper.

BRIEF DESCRIPTION OF THE FIGURES

FIG. 1 shows a table in which the values $d_{10}$, $d_{30}$, $d_{70}$, $d_{90}$ for eighteen different types of chalk are given. Further, the table shows the values for air permeability Z and diffusion capacity D* that result for cigarette papers which contain the respective chalk in a low (18% by weight) or high (28% by weight) amount.

FIG. 2 shows a table which contains the values $D^*_{50}$ and their difference $\Delta D^*_{50}$ for high and low chalk content for the same chalk types and papers as in table 1.

DESCRIPTION OF THE PREFERRED EMBODIMENTS AND COMPARATIVE EXAMPLES

Figure 3:
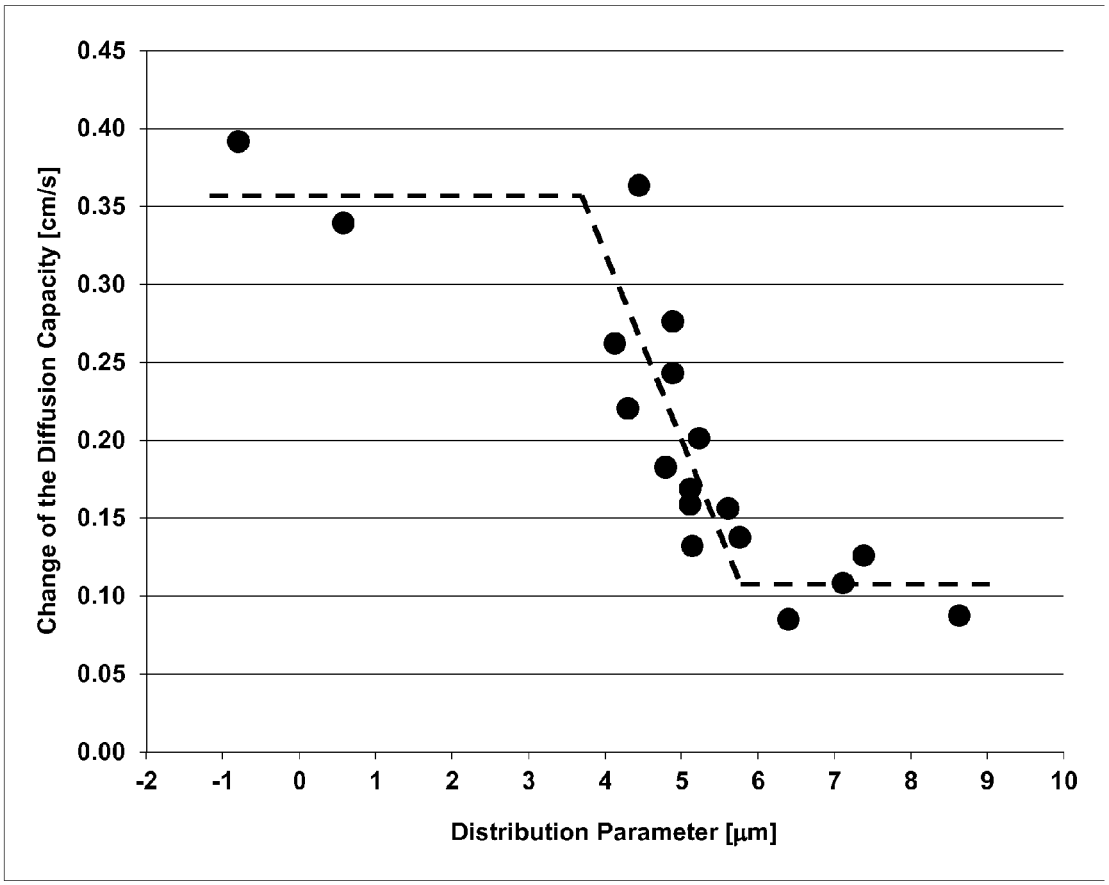
FIG. 3 shows a graphical representation of $\Delta D^*_{50}$ as a function of the distribution parameter $p=d_{10}+2\cdot d_{30}+2\cdot d_{70}-d_{90}$ of the particle size distribution for the papers and chalk types of FIG. 1.

To demonstrate the effect according to the invention, paper sheets from pulp fibers filled with one of eighteen different types of chalk with different particle size distributions were tested. In this respect, two paper sheets were manufactured per chalk type, one with a chalk content of about 18% by weight ("low" chalk content) and one with a chalk content of about 28% by weight ("high" chalk content). These percentages should be understood to mean the percent by weight relative to the mass of the paper sheet.

For each chalk type, the particle size distribution was determined by means of laser diffraction in accordance with ISO 13320. In this regard, all of the chalk types were measured using an instrument from the company CILAS with the designation CILAS 1064 (serial number 273) and the evaluation was carried out using "The Particle Expert" v 6.15 software. For the computer-based evaluation, the model according to Mie for calcite was used. The measurement was carried out by means of a wet dispersion, in which the sample was dispersed in a liquid with the ultrasonic disperser integrated into the measurement instrument. This ultrasonic disperser was used at a power of 50 Watt and a frequency of 38 kHz. The liquid used was distilled water. In total, for each measurement, 500 ml of water was placed in the dispersion unit of the measuring instrument. The sample quantity consisted of about 0.1 g of the material to be investigated in the dry state. Of each sample 6 measurements were carried out wherein, if one measurement deviated, a stability test of 15 measurements was carried out. The measurements were carried out according to the manual of the instrument used wherein, unless otherwise specified, the standard settings of the instrument were selected, and in accordance with ISO 13320. The evaluation of the particle size distribution by the instrument delivered the quantities $d_{10}$, $d_{30}$, $d_{70}$ and $d_{90}$, from which the distribution parameter p was calculated from $p=d_{10}+2\cdot d_{30}+2\cdot d_{70}-d_{90}$.

The same pulp fiber mixture, consisting of a mixture of short and long fibers, was used for all of the paper sheets, to cause the result to depend only on the particle size distribution of the chalk and the chalk content. Subsequent to the production of the paper sheets, the diffusion capacity and the air permeability were measured. The diffusion capacity D* of the papers was measured after conditioning in accordance with ISO 187 with a Sodim Paper Diffusivity Meter, Type 95X-2 (series 4, No. 26). The air permeability Z of the papers was determined in accordance with ISO 2965, wherein a measuring head with a rectangular opening of 10×20 mm was used. A summary of the measured values is shown in Table 1, which is given in FIG. 1.

The aim of the invention is to influence the diffusion capacity as strongly as possible and the air permeability as little as possible when the filler material content is changed. Since the paper sheets all have a different air permeability, it is necessary to normalize the values in the manner described above to a paper with a standard air permeability—in this case 50 CU.

The values in Table 2 are shown in FIG. 2, wherein $\Delta D^*_{50}$ designates the difference between the diffusion capacities $D^*_{50}$ at low and high chalk contents for a paper with 50 CU air permeability.

If the relationship between the distribution parameter p of the particle size distribution of the filler material and the change $\Delta D^*_{50}$ in the diffusion capacity is represented in a diagram, as it is in FIG. 3, then it can be seen that a particularly large change in the diffusion capacity can be obtained if the distribution parameter p is at most 5.0 μm, preferably at most 4.0 μm and particularly preferably at most 3.5 μm, but at the same time at least −1.0 μm, preferably at least 0.0 μm and particularly preferably at least 1.0 μm.

Hence, the papers with numbers 10 and 12-18 constitute embodiments according to the invention, while the other papers show that with filler materials with particle size distributions with a distribution parameter p outside the range according to the invention, the desired effect cannot be achieved.

Assuming that the air permeability Z and the diffusion capacity D* behave to a good approximation in accordance with $D^* \sim \sqrt{Z}$, then $\Delta D^*_{50}=0$, which should mean that in practice, the diffusion capacity cannot be set independently of the air permeability. On the other hand, values of $\Delta D^*_{50}$ which differ therefrom indicate a deviation from this strict relationship, which is exploited in the context of this invention. These larger values of $\Delta D^*_{50}$ are obtained, as the inventors could demonstrate, for filler materials with a particle size distribution with a distribution parameter p of between 5.0 μm and −1.0 μm, wherein the preferred upper limits for the distribution parameter p are at 4.0 μm, preferably 3.5 μm, and preferred lower limits are at 0.0 μm, preferably 1.0 μm.

It can also be seen from Table 2 that for the papers according to the invention with such a filler material particle size distribution, for an air permeability of Z=50 CU, a comparatively high absolute value for the diffusion capacity $\Delta D^*_{50}$ can be obtained; it is greater than 1.80 cm/s, preferably greater than 1.90 cm/s and in particlar greater than 2.0 cm/s.

The invention claimed is:

1. Cigarette paper which contains pulp fibers and filler material particles, wherein at least 90% by weight of the filler material has a particle size distribution, measured in accordance with ISO 13320 with Mie-correction for calcite, for which the distribution parameter $p=d_{10}+2\cdot d_{30}+2\cdot d_{70}-d_{90}$ holds:

$p\leq 5.0$ μm, and $p\geq -1.0$ μm, wherein said cigarette paper has an air permeability of x Coresta Unit and a diffusion capacity $D^*_x$ for $CO_2$, wherein $D^*_x\cdot\sqrt{50}/\sqrt{x}\geq 1.80$ cm/s, in which the basis weight is between 10 g/m$^2$ and 60 g/m$^2$, and in which the paper is treated with burn-retardant materials in discrete areas which are suitable for providing a cigarette manufactured from the paper with self-extinguishing properties.

2. Cigarette paper according to claim 1, in which the filler material consists entirely or partially of precipitated chalk.

3. Cigarette paper according to claim 1, wherein $20\leq x\geq 120$.

4. Cigarette paper according to claim 1, in which the median value d50 of the particle size distribution measured in accordance with ISO 13320 with Mie-correction for calcite is between 0.5 μm and 4.0 μm.

5. Cigarette paper according to claim 1, in which the total filler material content of the paper is between 10% by weight and 45% by weight.

6. Cigarette comprising a tobacco rod and a cigarette paper wrapping the tobacco rod, wherein the cigarette paper contains pulp fibers and filler material particles, wherein at least 90% by weight of the filler material has a particle size distribution, measured in accordance with ISO 13320 with Mie-correction for calcite, for which the distribution parameter $p=d_{10}+2\cdot d_{30}+2\cdot d_{70}-d_{90}$ holds:

$p\leq 5.0$ μm, and $p\geq -1.0$ μm, wherein said cigarette paper has an air permeability of x Coresta Unit and a diffusion capacity $D^*_x$ for $CO_2$, wherein $D^*_x\cdot\sqrt{50}/\sqrt{x}\geq 1.80$ cm/s, in which the basis weight is between 10 g/m$^2$ and 60 g/m$^2$, and in which the paper is treated with burn-retardant materials in discrete areas which are suitable for providing the cigarette with self-extinguishing properties.

7. Cigarette paper according to claim 1, for which the distribution parameter $p=d_{10}+2\cdot d_{30}+2\cdot d_{70}-d_{90}$ holds:

$p\leq 4.0$ μm and $p\geq -1.0$ μm.

8. Cigarette paper according to claim 1, for which the distribution parameter $p=d_{10}+2\cdot d_{30}+2\cdot d_{70}-d_{90}$ holds:

$p\leq 3.5$ μm and $p\geq -1.0$ μm.

9. Cigarette paper according to claim 1, with an air permeability of x Coresta Unit and a diffusion capacity $D^*_x$ for $CO_2$, wherein $D^*_x\cdot\sqrt{50}/\sqrt{x}\geq 1.90$ cm/s.

10. Cigarette paper according to claim 1, with an air permeability of x Coresta Unit and a diffusion capacity $D^*_x$ for $CO_2$, wherein $D^*_x\cdot\sqrt{50}/\sqrt{x}\geq 2.0$ cm/s.

11. Cigarette paper according to claim 3, wherein $30\leq x\leq 100$.

12. Cigarette paper according to claim 4, in which the median value $d_{50}$ of the particle size distribution measured in accordance with ISO 13320 with Mie-correction for calcite is between 0.5 μm and 3.0 μm.

13. Cigarette paper according to claim 5, in which the total filler material content of the paper is between 20% by weight and 40% by weight.

14. Cigarette paper according claim 1, in which the basis weight is between 20 g/m$^2$ and 35 g/m$^2$.

* * * * *